United States Patent [19]

Kehl

[11] 4,416,197

[45] Nov. 22, 1983

[54] WASTE MATERIAL COMPACTOR APPARATUS

[76] Inventor: Charles W. Kehl, 11466 Irvington, Warren, Mich. 48093

[21] Appl. No.: 311,346

[22] Filed: Oct. 14, 1981

[51] Int. Cl.[3] ..... B30B 15/06

[52] U.S. Cl. ..... 100/214; 100/229 A; 100/245; 100/246; 100/295; 220/1 T

[58] Field of Search ..... 100/240, 245, 295, 226, 100/229 A, 227, 228, 246, 247, 248, 265, 295, 214; 220/1 T, 23, 254; 215/231

[56] References Cited

U.S. PATENT DOCUMENTS

| | | | |
|---|---|---|---|
| 2,800,244 | 7/1957 | Witt | 220/254 |
| 2,802,590 | 8/1957 | Tupper | 220/23 |
| 3,749,274 | 7/1973 | Mele | 220/1 T X |
| 3,863,563 | 2/1975 | Popeil | 100/245 X |
| 3,946,662 | 3/1976 | Ross, Jr. et al. | 100/240 |
| 4,331,074 | 5/1982 | Behman | 100/245 X |

*Primary Examiner*—Billy J. Wilhite

*Attorney, Agent, or Firm*—Basile, Weintraub & Hanlon

[57] ABSTRACT

Apparatus for compacting waste material. The apparatus includes a over adapted to close the open end of a waste container. The cover includes a lip member adapted to engage the top ends of the container. The lip member has a central aperture formed therein. A cover member having a shape proximate the shape of the central aperture in the lip member is removably supported on the lip member to close the central aperture. The cover member is adapted to be inserted through the central aperture in the lip member into the interior of the container and urged downward to compact the contents of the container.

21 Claims, 7 Drawing Figures

12
20
28
18
10
14
21
101
44
36
34
31
26
24
16
42
40
22
30
32
2

52
54
43
41
50

WASTE MATERIAL COMPACTOR APPARATUS

BACKGROUND OF THE INVENTION

1. Field Of The Invention

This invention relates, in general, to containers and, more specifically, to containers incorporating a waste material compactor apparatus.

2. Description Of The Prior Art

Today's modern society is generating ever increasing amounts of waste material, such as refuse, garbage and trash, which must be efficiently removed from the residential home or commercial establishment.

One common way of disposing of trash and refuse and, in particular, refuse generated in a residential home, is through the use of a conventional waste receptacle or garbage can into which is inserted a flexible bag, such as a plastic garbage bag. The refuse is deposited in the bag, and when it is full, the open end of the bag is closed and tied off before the bag is removed from the container and taken to the disposal site. Although this waste disposal system is effective at providing a quick and easy method of disposing of refuse, it is not without drawbacks. Typically, the refuse or trash generated in a residential home includes many cans, cartons and other types of containers which consume a considerable amount of space or volume within the waste receptacle but weigh very little. Thus, a considerable number of trash bags are utilized to collect and dispose of the refuse or trash. In order to fit more refuse into the bag supported in the container, the residential home owner can manually compact the refuse by pushing down on top of the refuse in the container by hand. At best, this is a dirty, inconvenient task.

Due to the volume of waste material that is typically generated in a residential home, a considerable number of trashbags are used. Thus, the expense of waste material disposal is increased due to the ever increasing cost of the plastic bags and, as the number of such bags typically used increases, so does the time required to dispose of the waste.

The waste material also includes objects such as cans, containers, etc., having sharp corners or edges which can easily rip or tear the flexible plastic bag. This leads to spillage of the refuse from the bag as it is being carried to the disposal site which again creates additional work and increased costs. One solution is to utilize a plastic bag having increased wall thickness in order to provide greater tear or rip resistance. However, these bags have a considerably higher cost and are still susceptible to ripping due to the sharp edges of the containers jutting through the bag when the bag is lifted out of the refuse container and carried to the disposal site.

It is also known to provide a mechanically operated compactor unit for reducing the volume of refuse or trash generated in a residential home or commercial establishment. Such units are typically stand alone devices operated by electrical power and through a ram and associated drive mechanism compact the refuse deposited in a suitable bag mounted in the compactor unit. Although effective, these units consume energy, are bulky and expensive.

Thus, it would be desirable to provide a waste material disposal apparatus which overcomes the problems of similar prior art refuse disposal devices. It would also be desirable to provide a waste material disposal apparatus which provides more efficient collection of waste material. It would also be desirable to provide a waste material disposal apparatus in which the occurrence of rips or tears in the bag during compacting are minimized. It would also be desirable to provide a waste disposal system which is usable with flexible bags and, in particular, plastic bags. Finally, it would be desirable to provide a waste material disposal apparatus which enables thinner plastic bags to be used for the collection and disposal of waste material.

SUMMARY OF THE INVENTION

There is disclosed herein a unique apparatus for disposing of and compacting waste material. The apparatus includes a cover which is adapted to be disposed over the open top end of the container portion of a waste receptacle. The cover includes a lip member adapted to engage the upper top end of the container. The lip member has a central aperture formed therein.

A cover member is provided to removably close the central aperture in the lip member. The cover member is also adapted to be inserted through the central aperture in the lip member and urged downwards into the container to compact the waste material contained therein.

In one embodiment, the cover member is supported on a pair of flanges extending inward from the edges of the central aperture in the lip member. In a preferred embodiment, the central aperture has an oblong configuration, with the cover member having a shape proximate that of the central aperture but with larger corresponding dimensions such that the peripheral edges of the cover member overlie the edges of the central aperture. Centering means connected to the underside of the cover member is adapted to fit within the edges of the central aperture of the lip member.

The waste material compactor apparatus of the present invention is ideally suited for use with flexible trash bags and, more particularly, plastic trash bags, which are inserted within the waste receptacle and supported at their upper end by folding the upper end over the top end of the container. In this application, the lip member traps and secures the upper end of the bag in position to support the bag securely within the container and prevent the upper end from pulling away from the container when the trash or refuse is deposited therein or during compacting.

Waste material may be deposited into the bag through the central aperture in the lip member when the cover member is removed. In addition, the cover member may be inserted through the central aperture in the lip member to compact the waste which thereby enables increased amount of waste to be stowed within each bag. It has been found that approximately two to three times as much waste may be deposited in a conventional trash bag then previously possible using other compacting methods.

Furthermore, since the waste material is compacted in the bag while the bag is supported within the refuse container, the possibility that the sharp edges of the waste products will jut through the sides of the bag and tear or rip the bag which can lead to a complete opening of the bag and spillage of the contents therefrom is significantly minimized. This enables bags having thinner wall thicknesses to be used which, in connection with the increased amount of refuse that may be stored in each bag, significantly reduces the user's costs for waste disposal.

Another advantage of the present invention is the ease of compacting the waste material. The user does not have to use his hands to compact the trash; but, rather, uses the cover member to compact the trash and thus never touches the messy waste material. In addition, increased amounts of force may be applied through the cover member than possible when compacting waste by hand only so as to further compact the trash into as small a volume as possible.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figures 1, 2, 3, 4:
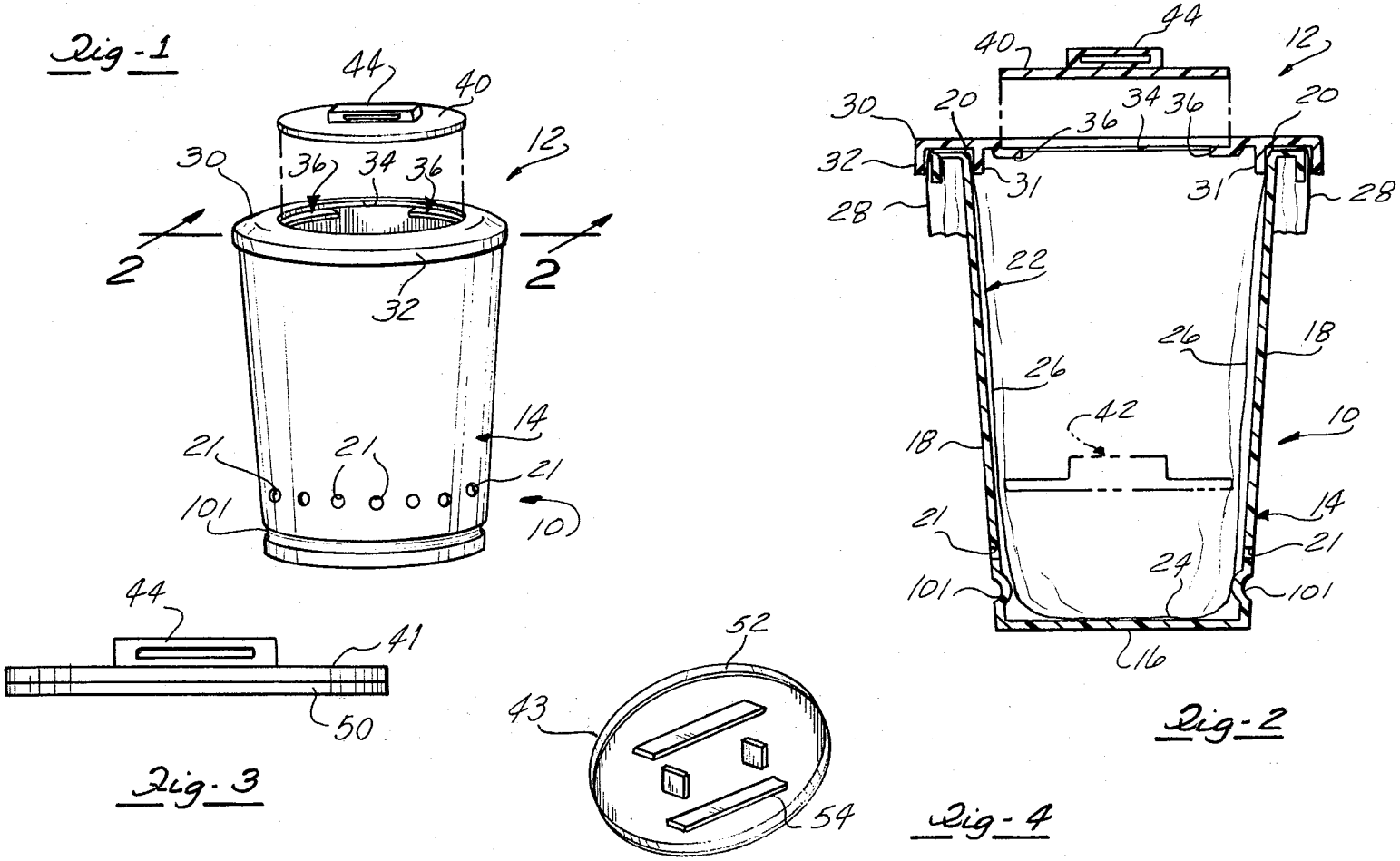
FIG. 1 is a perspective, exploded view of the waste material compactor apparatus of the present invention.
FIG. 2 is a cross sectional view generally taken along line 2—2 in FIG. 1.
FIG. 3 is a perspective view of another embodiment of the cover member of the present invention.
FIG. 4 is a perspective view of yet another embodiment of the cover member of the present invention.

Throughout the following detailed description and drawing, an identical reference number is used to refer to the same component shown in multiple figures of the drawing.

Referring now to the drawing, and to FIGS. 1 and 2 in particular, there is illustrated a waste material compactor apparatus 10 constructed in accordance with the teachings of the present invention which is suited for collecting and compacting waste material, such as trash, garbage and refuse, which is generated by a residential home or commercial establishment. The waste material compactor apparatus 10 of the present invention comprises a cover 12 which is adapted to removably close the open top end of a conventional refuse receptacle or container 14 and, at the same time, is adapted to compact the trash or refuse disposed within the refuse container 14.

Specifically, the waste material compactor apparatus 10 of the present invention is suited for use with a refuse container or trash can 14. The container 14 includes a closed bottom 16, upstanding side walls 18 and an open top end which terminates in an outwardly extending flange 20. The flange 20 is formed by rolling over the upper top end of the side walls 18 of the container 14.

By way of illustration and not of limitation, the container 14 is illustrated as having a substantially cylindrical shape with a circular cross section. This is not meant to exclude the use of the cover 12 with waste receptacles having other shapes, such as rectangular, square, oblong, etc.

As shown in FIG. 2, the open top end of the container 14 has a slightly larger diameter then the diameter of the bottom end 16. The side walls 18 taper inward at a slight angle between the open end and the bottom end 16.

The refuse container 14 can be formed of any suitable material, such as steel or aluminum. Preferably, however, the refuse container 14 is formed of a flexible material, such as rubber or plastic.

A plurality of apertures 21 are formed about the periphery of the side walls 18 adjacent to the bottom end 16 of the container 14 and extend completely therethrough. The apertures 21 allow air to escape from the interior of the container 14 to enable quick and easy compacting of the contents of the container 14.

As shown in FIG. 2, a conventionally constructed trash bag 22 is disposed within the refuse container 14. The trash bag 22 which may be constructed of any suitable material, such as a thin walled plastic sheet, is typically formed with a closed bottom 24, sides 26 and an open top end or mouth 28. The bag 22 is supported within the container 14 by folding the top end 28 over the upper flange 20 of the container 14.

In use, waste material is deposited into the bag 22 supported within the container 14 and, when the bag is full, its open top end 28 is closed and tied off and the bag 22 removed from the container 14 for subsequent disposal.

As shown in both FIGS. 1 and 2, the cover 12 includes a lip member 30 which is adapted to engage the top end 20 of the container 14, preferably, in a sealing manner. Due to the cylindrical, circular cross section configuration of the refuse container 14, the lip member 30 has a similar circular cross section. However, it will be understood that the lip member 30 may be formed in other shapes so as to coincide with the shape of the container 14.

The lip member 30 is in the form of an annular, ring-like member having depending spaced annular flanges 31 and 32 extending completely therearound. The flanges 31 and 32 are adapted to be disposed over and releasably engage the flange 20 on the container 14.

The lip member 30 is formed with a central aperture 34 which in one embodiment is circular in cross section. The aperture 34 has a diameter slightly smaller then the diameter of the bottom end 16 of the container 14 for reasons which will be described in greater detail hereafter.

The lip member 30 also includes means, denoted in general by reference number 36, for supporting a removable cover member 40. In the preferred embodiment, the supporting means 36 comprises a pair of flanges 36 which are integrally formed with or secured to the inner edges of the central aperture 34 in the lip member 30 and extend inward into the aperture 34 below the top surface of the lip member 30. In addition, the flanges 36 extend partially around the periphery of the central aperture 34 such that a space is formed between opposed side edges of the flanges 36. The flanges 36 function to removably support the cover member 40 on the lip member 30 such that the cover member 40 forms a contiguous surface with the top surface of the lip member 30. In addition, the flanges 36 permit the cover member 40 to be flipped upward or downward and inserted through the spaces formed between opposed side edges of the flanges 36 into the container 14 for compacting the contents therein, as will be described in greater detail hereafter.

As shown in FIGS. 1 and 2, the cover member 40 has a shape proximate the shape of the central aperture 34 in the lip member 30. Thus, in the preferred embodiment illustrated in FIG. 1 and 2, the cover member 40 has a circular cross section. The diameter of the cover member 40 is slightly less then the diameter of the bottom end 16 of the container 14 to enable the cover member 40 to be urged substantially to the bottom of the container 14, as illustrated in phantom by reference number 42 in FIG. 2, so as to compact all of the contents of the container 14.

Preferably, the cover member 40 is formed of the same material as the lip member 30, such as rubber or plastic; although rigid metallic materials may also be used. The only requirement for the choice of material used to form the cover member 40 is that it has sufficient rigidity so as to enable the cover member 40 to perform the function of compacting waste material contained within the container 14.

As shown in FIG. 1, the cover member 40 is formed with an integrally attached handle 44 of any configuration which enables the cover member 40 to be grasped and removed from the lip member 30 such that waste may be deposited therethrough and, also, to provide a convenient means for urging the cover member 40 into the container 14 for compacting the waste material.

Referring now to FIGS. 3 and 4, there is illustrated additional embodiments of the cover member which provide enhanced rigidity for the cover member so as to improve the efficiency of the compacting operation.

As shown in FIG. 3, the cover member 41 has a plate member 50 secured to the underside thereof. The plate member 50 has substantially the same shape as the cover member 41 and may be secured thereto by any conventional means, such as adhesive.

As shown in FIG. 4, increased rigidity for the cover member 41 may be provided by means of a peripheral flange 52 and a plurality of integrally formed ribs 54 which extend downward from the underside of the cover member 43.

In use, the trash bag 22 is inserted within the waste receptacle 14 and its upper edges 28 folded over the upper flange 20 of the waste receptacle 14. The cover 12 is disposed over the upper end of the receptacle 14 with the lip member 30 engaging the upper flange 20 of the waste receptacle 14 to trap and secure the folded over edges 28 of the trash bag 22 between the flanges 31 and 32 on the lip member 30 and the flange 20 on the container 14. The trash bag 22 is thus supported at its upper end 28 within the waste receptacle 14 and extends downward within the interior of the receptacle 14 with its sides 26 and bottom 24 in substantial registry with the side walls 18 and bottom end 16 of the waste receptacle 14. The cover member 40 may be engaged with the lip member 30 to close the central aperture 34 therein and to substantially seal the interior of the waste receptacle 14. The cover member 40 may also be removed by grasping the handle 44 and pulling upward such that waste material may be deposited into the trash bag 22 through the central aperture 34.

In addition, the cover member 40 may be removed from the lip member 30, rotated to an upwardly extending vertical position and urged through the central aperture 34 between the spaces formed between the opposed side edges of the flanges 36 and slid back into a substantially horizontal position underneath the lip member 30. Downward force may be exerted on the cover member 40 urging it downward into the container 14 to compact the contents of the container 14 and thereby enable increased amounts of waste material to be stored within the trash bag 22.

Figure 5:
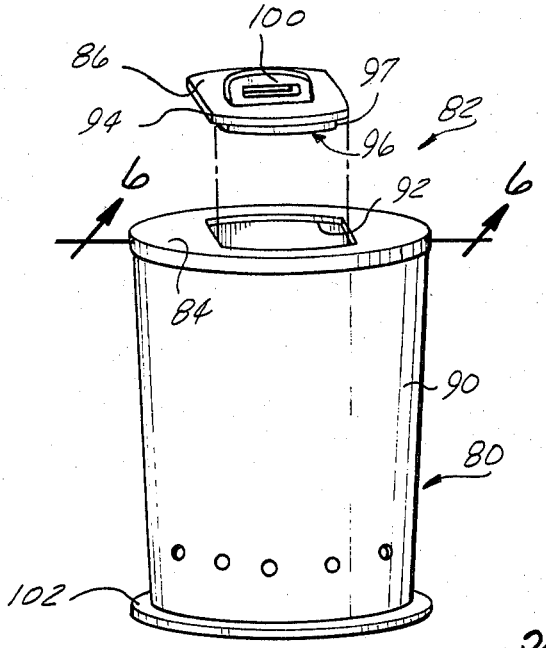
FIG. 5 is a perspective, exploded view of another embodiment of the waste material compactor apparatus of the present invention.
Figure 6:
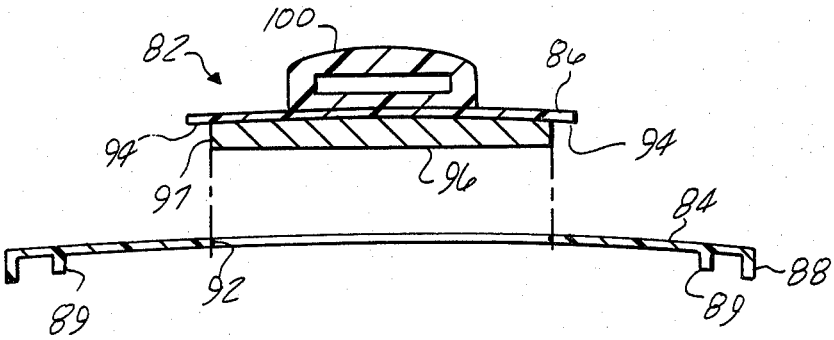
FIG. 6 is a partial cross sectional view generally taken along line 6—6 in FIG. 5.

Referring now to FIGS. 5 and 6, there is illustrated a more preferred embodiment of the present invention. The waste material compactor apparatus 80 shown therein functions in the same manner as that described above and illustrated in FIGS. 1 and 2 insofar as providing a convenient receptacle for waste material, and at the same time, enabling manual compacting of the contents thereof.

In this embodiment, the waste material compactor apparatus 80 includes a cover 82 which comprises a lip member 84 and cover member 86.

The lip member 84 has a circular cross section with depending spaced annular flanges 88 and 89 depending from its outer periphery which are adapted to engage the upper end of the side walls of the container 90. The lip member 84 has a central aperture 92 formed therein. In this preferred embodiment, the central aperture 92 has a non-circular or oblong configuration with the dimension along one major axis exceeding the dimension of the other major axis. The central aperture 92 preferably is substantially rectangular in shape with straight and slightly curved sides. Alternately, the aperture 92 may be oval in configuration.

Means are provided for removably supporting the cover member 86 on the lip member 84 so as to close the aperture 92. In this embodiment, the supporting means comprises the cover member 86 having a shape proximate the shape of the central aperture 92 in the lip member 82 with its peripheral dimensions being slightly larger than the corresponding dimensions of the central aperture 92 such that the peripheral edges 94 of the cover member 86 overlay the edges of the central aperture 92. Preferably, he dimensions of the cover member 86 are selected such that the peripheral edges 94 thereof overlay the edges of the central aperture 92 by approximately ½ inch so as to completely close the aperture 92 when the cover member 86 is disposed on the lip member 84.

Centering means 96 is provided on the cover member 86. The centering means 96 depends from the underside of the cover member 86 and is adapted to be disposed within the central aperture 92 in the lip member 84 for centering the cover member 86 on the lip member 84 to completely close the central aperture 92 therein.

As shown in FIGS. 5 and 6, the centering means 96 in one embodiment comprises a planar plate member 97 which is secured by any suitable type of fastening means, such as adhesive, to the underside of the cover member 86. The plate member 97 is formed with a configuration proximate the configuration of the central aperture 92 so as to closely fit with the edges of the central aperture 92. In this manner, the cover member 86 is automatically centered within the central aperture 92 so as to completely close the central aperture 92.

Figure 7:
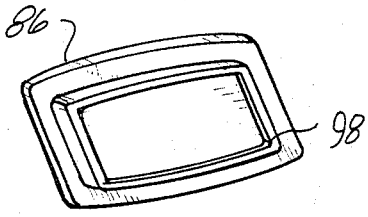
FIG. 7 is a perspective view of another embodiment of the cover member shown in FIG. 6.

Alternately, the centering means 96 may comprise a flange 98, as shown in FIG. 7, which depends from the underside of the cover member 86. The flange 98 may be integrally formed with the cover member 86 and includes four connected sections which are formed in a configuration proximate the configuration of the central aperture 92. Alternately, the entire center portion bounded by the flange 98 could be solid and flush with the cover edge of the flange 98. In either version, the side walls of the flange 98 will be disposed in close proximity to the peripheral edges of the central aperture 92 when the cover member 86 is disposed on the lip member 84.

When the waste material compactor apparatus 80 is used to manually compact waste material disposed within the container 90, a suitably formed handle means 100 is grasped and lifted upward thereby removing the cover member 86 from the lip member 84 and exposing the central aperture 92. The entire cover member 86 is then rotated in a vertical direction and inserted through the central aperture along a diagonal or the narrower width of the central aperture 92. The cover member 86 is then rotated to a substantially horizontal position and urged downward into the container 90 to compact the contents thereof.

Referring again to FIG. 5, there is shown another feature of the waste material compactor apparatus 80 of the present invention. Retaining means is formed on the container 90 for holding the container 90 in a stationary position during compacting or removal of the trash bag. In one embodiment, the retaining means comprises at least one flange 102 located adjacent the bottom of the container 90. The flange 102 extends outward from the container 90. Preferably, the flange 102 extends completely around the circumference of the container 90; although the provision of two shorter flanges on opposed sides of the container 90 is also possible.

The flange 102 provides a support for the user of the waste material compactor apparatus 80 to place his feet thereon in order to hold the container 90 stationary during the compacting operation and, also, to enable the bag containing the waste material to be lifted out of the container 90 and separated therefrom. Alternately, an annular recess 101, shown in FIGS. 1 and 2, may be formed in the side walls of the container adjacent the bottom end. The user can insert his feet on the sides thereof into the recess 101 to hold the container stationary.

Thus, there has been disclosed a waste material compactor apparatus which provides an efficient and easy method for compacting trash or refuse. The waste material compactor apparatus enables increased amounts of refuse or trash to be stored within a conventional flexible trash bag and, at the same time, substantially prevents such waste material from ripping or tearing the bag and causing a complete opening of the bag and spillage of its contents as it is carried to the disposal site. As a result, trash bags having thinner walls may be utilized without fear of tearing which, in conjunction with the increased amounts of waste material which may be stored within each bag, significantly reduces the user's costs in procuring and using flexible trash bags to secure and dispose of waste material.

What is claimed is:

1. A cover for a waste receptacle having an open top end comprising:

a lip member adapted to engage the top end of the receptacle, the lip member having a central aperture;

a cover member having a shape proximate the shape of the central aperture for removably closing the central aperture in the lip member and adapted to be inserted through the central aperture into the waste receptacle for compacting the contents thereof; and flanges formed on the lip member adjacent to and extending inward from the edges of the central aperture, the flanges supporting the cover member thereon to close the central aperture in the lip member.

2. The cover of claim 1 wherein the central aperture in the lip member and the cover member have a circular cross sectional configuration; and the flanges comprise a pair of flanges, each extending partially around the periphery of the central aperture in the lip member such that openings are formed between the spaced ends thereof, the opening enabling the cover member to be urged therethrough below the lip member.

3. The cover of claim 1 wherein the cover member further includes reinforcing means for increasing the rigidity thereof.

4. The cover of claim 3 wherein the reinforcing means includes a plate member secured to the underside of the cover member.

5. The cover of claim 3 wherein the reinforcing means includes a plurality of depending ribs secured to the underside of the cover member.

6. A cover for a waste receptacle having an open top end comprising:

a lip member adapted to engage the top end of the receptacle, the lip member having a central aperture;

a cover member for removably closing the central aperture in the lip member and adapted to be inserted through the central aperture into the waste receptacle for compacting the contents thereof;

the central aperture in the lip member and the cover member each having an oblong shape with a length dimension larger than a width dimension, the length and width dimensions of the cover member being larger than the corresponding length and width dimensions of the central aperture such that the peripheral edges of the cover member overlay the edges of the central aperture; and centering means mounted on and depending from the cover member and adapted to be disposed within the central aperture for centering the cover member on the lip member to close the central aperture therein.

7. The cover of claim 6 wherein the centering means comprises a plate member secured to the underside of the cover member, the plate member having a shape proximate the shape of the central aperture so as to fit in close proximity therein.

8. The cover of claim 6 wherein the centering means comprises a flange depending from the underside of the cover member and having a shape proximate the shape of the central aperture so as to fit in close proximity therein.

9. A receptacle for waste material comprising:

a container having an open top end, upstanding side walls and a closed bottom;

a cover adapted to close the open top end of the container, the cover comprising:

a lip member adapted to engage the open top end of the container, the lip member having a central aperture;

a cover member having a shape proximate the shape of the central aperture in the lip member for removably closing the central aperture in the top member and adapted to be inserted through the central aperture into the receptacle for compacting the contents thereof; and flanges formed on the lip member adjacent to and extending inward from the edges of the central aperture, the flanges supporting the cover member thereon to close the central aperture in the lip member.

10. The receptacle of claim 9 wherein the central aperture in the lip member and the cover member have a circular configuration; and the flanges comprised a pair of flanges, each extending partially around the periphery of the central aperture in the lip member such that openings are formed between the spaced ends thereof, the openings enabling the cover member to be urged therethrough below the lip member.

11. The receptacle of claim 9 wherein a plurality of spaced apertures are formed in the side walls of the container around the periphery thereof, the apertures extending completely through the side walls.

12. The receptacle of claim 9 wherein the cover member further includes reinforcing means for increasing the rigidity thereof.

13. The receptacle of claim 12 wherein the reinforcing means includes a plate member secured to the underside of the cover member.

14. The receptacle of claim 12 wherein the reinforcing means comprises a plurality of depending ribs secured to the underside of the cover member.

15. The receptacle of claim 9 wherein the cover member has a size smaller then the size of the bottom of the container so as to be urged in substantial proximity therewith to compact the contents of the container.

16. The receptacle of claim 9 wherein the container includes retaining means, located adjacent the bottom thereof, for retaining the container in a stationary position.

17. The receptacle of claim 9 further including:

a flexible walled bag having a closed bottom and an open top end, the upper top end of the bag being adapted to be folded over the upper ends of the side walls of the container and supported therfrom within the interior of the container; and the lip member having a peripheral flange for securely retaining the folded over end of the bag on the upper ends of the side walls of the container.

18. The receptacle of claim 17 wherein the lip member includes:

an annular flange spaced from the peripheral flange, the peripheral and annular flanges adapted to be disposed on opposite side of the upper end of the side walls of the container.

19. A receptacle for waste material comprising:

a container having an open top end, upstanding side walls and a closed bottom;

a cover adapted to close the open top end of the container, the cover comprising:

a lip member adapted to engage the open top end of the container, the lip member having a central aperture;

a cover member having a shape proximate the shape of the central aperture in the lip member for removably to be inserted through the central aperture into the receptacle for compacting the contents thereof;

the central aperture in the lip member and the cover member each having an oblong shape with a length dimension larger than a width dimension, the length and width dimensions of the cover member being larger than the corresponding length and width dimensions of the central aperture such that the peripheral edges of the cover member overlay the edges of the central aperture; and centering means mounted on and depending from the cover member and adapted to be disposed within the central aperture for centering the cover member of the lip member to close the central aperture therein.

20. The receptacle of claim 19 wherein the centering means comprises a plate member secured to the underside of the cover member, the plate member having a shape proximate the shape of the central aperture so as to fit in close proximity therein.

21. The receptacle of claim 19 wherein the centering means comprises a flange depending from the underside of the cover member and having a shape proximate the shape of the central aperture so as to fit in close proximity therein.

* * * * *